US007121919B2

(12) United States Patent
Farrar

(10) Patent No.: US 7,121,919 B2
(45) Date of Patent: Oct. 17, 2006

(54) CHEMICAL MECHANICAL POLISHING SYSTEM AND PROCESS

(75) Inventor: Paul A. Farrar, So. Burlington, VT (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/944,983

(22) Filed: Aug. 30, 2001

(65) Prior Publication Data

US 2003/0045206 A1 Mar. 6, 2003

(51) Int. Cl.

| | |
|---|---|
| ***B24B 1/00*** | (2006.01) |
| ***B24B 3/00*** | (2006.01) |
| ***B24B 33/00*** | (2006.01) |
| ***B24B 49/00*** | (2006.01) |

(52) U.S. Cl. ..... 451/5; 451/56; 451/213; 451/218; 451/221; 451/443; 451/41

(58) Field of Classification Search ..... 451/5, 451/36, 41, 56, 60, 63, 213, 212, 218, 221, 451/443, 444

See application file for complete search history.

(56) References Cited

U.S. PATENT DOCUMENTS

| | | | | |
|---|---|---|---|---|
| 3,233,369 | A * | 2/1966 | Highberg | 451/260 |
| 3,943,666 | A * | 3/1976 | Dion et al. | 451/28 |
| 4,476,601 | A * | 10/1984 | Oka | 15/88.3 |
| 4,486,826 | A * | 12/1984 | Wolff et al. | 714/9 |
| 4,656,790 | A * | 4/1987 | Mukai et al. | 451/28 |
| 5,390,132 | A * | 2/1995 | Shioe et al. | 709/224 |
| 5,483,568 | A * | 1/1996 | Yano et al. | 438/16 |
| 5,707,272 | A * | 1/1998 | Hashimoto et al. | 451/41 |
| 5,707,274 | A * | 1/1998 | Kim et al. | 451/285 |
| 5,733,175 | A | 3/1998 | Leach | 451/41 |

(Continued)

FOREIGN PATENT DOCUMENTS

JP 61-152367 * 7/1986

OTHER PUBLICATIONS

Anonymous, "Improved Metallurgy for Wiring Very Large Scale Integrated Circuits", *International Technology Disclusures*, 4(9), (1986), 1 page.

(Continued)

*Primary Examiner*—M. Rachuba
(74) *Attorney, Agent, or Firm*—Schwegman, Lundberg, Woessner & Kluth, P.A.

(57) ABSTRACT

Chemical mechanical polishing (CMP) systems and methods are provided herein. One aspect of the present subject matter is a polishing system. One polishing system embodiment includes a platen adapted to receive a wafer, and a polishing pad drum that has a cylindrical, or generally cylindrical, shape with a length and an axis of rotation along the length. The polishing pad drum is adapted to rotate about the axis of rotation along the drum length. The polishing pad drum, the platen, or both the polishing pad drum and the platen are adapted to be linearly moved to polish the surface of the wafer using the rotating polishing pad drum. The polishing pad drum and the platen are adapted to be operably positioned a predetermined minimum distance from each other as the polishing pad drum and the platen pass each other due the linear motion.

86 Claims, 9 Drawing Sheets

U.S. PATENT DOCUMENTS 5,827,115 A * 10/1998 Shimizu ..... 451/123
5,934,980 A * 8/1999 Koos et al. ..... 451/41
5,958,794 A * 9/1999 Bruxvoort et al. ..... 438/692
5,964,652 A * 10/1999 Melzner et al. ..... 451/285
6,059,649 A 5/2000 Ballard ..... 451/296
6,093,085 A * 7/2000 Yellitz et al. ..... 451/41
6,093,087 A 7/2000 Hakomori et al. ..... 451/57
6,103,628 A 8/2000 Talieh ..... 438/692
6,126,523 A * 10/2000 Moriyasu et al. ..... 451/56
6,139,409 A 10/2000 Inaba ..... 451/288
6,143,123 A 11/2000 Robinson et al. ..... 156/344
6,152,805 A 11/2000 Takahashi ..... 451/36
6,165,056 A 12/2000 Hayashi et al. ..... 451/281
6,168,684 B1 1/2001 Mitsuhashi et al. ..... 156/345
6,171,513 B1 1/2001 Davis ..... 216/88
6,203,414 B1 3/2001 Numoto et al. ..... 451/288
6,207,572 B1 3/2001 Talich ..... 438/692
6,210,525 B1 4/2001 James et al. ..... 156/345
6,213,852 B1 4/2001 Fujii et al. ..... 451/285
6,213,853 B1 4/2001 Gonzalez-Martin et al. 451/287
6,217,427 B1 4/2001 Case et al. ..... 451/296
6,358,128 B1 * 3/2002 Sakurai et al. ..... 451/67
6,419,443 B1 * 7/2002 Takenoshita et al. ..... 415/11

OTHER PUBLICATIONS

Braud, F.., "Ultra Thin Diffusion Barriers for Cu Interconnections at The Gigabit Generation and Beyond", *VMIC Conference Proceedings*, (1996),pp. 174-179.
Ding,"Copper Barrier, Seed Layer and Planerization Technologies", *VMIC Conference Proceedings*, (1997),pp. 87-92.
Iijima, T..,"Microstructure and Electrical Properties of Amorphous W-Si-N Barrier Layer for Cu Interconnections", *1996 VMIC Conference*, (1996),pp. 168-173.
Laursen, T.., "Encapsulation of Copper by Nitridation of Cu-Ti Alloy/Bilayer Structures", *International Conference on Metallurgical Coatings and Thin Films*, Abstract No. H1.03, San Diego, CA,(Apr. 1997), p. 309.
Marcadal, C.., "OMCVD Copper Process for Dual Damascene Metallization", *VMIC Conference*, ISMIC,(1997),pp. 93-97.
RYU, C..,et al. ,"Barriers for copper interconnections", *Solid State Technology*, (1999),pp. 53, 54, 56.
Wrschka, P.., et al. ,"Chemical Mechanical Planarization of Copper Damascene Structures", *Journal of the Electrochemical Society*, 147(2), (2000),pp. 706-712.

* cited by examiner

CHEMICAL MECHANICAL POLISHING SYSTEM AND PROCESS

TECHNICAL FIELD OF THE INVENTION

This invention relates generally to semiconductor processing and, more particularly, to chemical mechanical polishing systems and processes.

BACKGROUND OF THE INVENTION

One problem that is confronting the semiconductor processing industry in the age of ultra large scale integration (ULSI) is capacitive-resistance loss in wiring levels. Conventionally, aluminum and aluminum alloys have been used for semiconductor wiring. In an effort to improve conductivity, it has been suggested to substitute copper metallurgy for aluminum metallurgy.

However, problems have been encountered in developing copper metallurgy. One problem is that copper quickly diffuses through both silicon and silicon dioxide ($SiO_2$). Another problem is the known junction poising effects of copper. It has been proposed to use a liner to separate the copper metallurgy from the $SiO_2$ insulator. Proposed liners include either a metal such as tantalum (Ta) or tungsten (W), or a compound such as tantalum nitride (TaN) or silicon nitride ($Si_3N_4$). Another problem is that copper, unlike aluminum, does not form a volatile compound at room temperature and thus cannot be reactively ion etched. The "damascene" process has been used to form copper lines embedded in an insulator. In this process, a layer of insulator is deposited, and trenches for conductors are formed in the insulator using a resistive ion etching (RIE) process. A liner and adhesion layer is deposited, and copper is blanked deposited by either chemical vapor deposition (CVD) or electroplating. The unwanted copper and liner is then removed by a chemical mechanical polishing (CMP) process.

CMP is a semiconductor wafer flattening and polishing process that combines the chemical removal of semiconductor layers such as insulators and metals with the mechanical buffering of a wafer surface. Typically, CMP is used to polish or flatten wafers after crystal growth during the wafer fabrication process, and to polish or flatten the profiles that build up in multilevel metal interconnection schemes.

A traditional CMP tool has a hard surface platen onto which the wafer is fixed. A polishing abrasive is applied and a polishing pad, which may contain additional abrasive, is moved over the wafer surface. The polishing solution containing the abrasive is, at least to some extent, generally reactive to the materials being polished. In one known polishing system, the abrasive is fixed to the pad and the pad is immersed in a liquid. This pad is then used in a similar method as the other systems.

In many CMP systems, the wafer platen and the polishing pad are rotated during the polishing process. Some designs have used a belt that contains an abrasive material. These systems have been used to achieve a significant degree of local planarization as well as limited long range planarization. However the degree of long range planarization has been significantly less than desired. Additionally, other non uniformity problems such as dishing and rounding of the features tend to occur. These non uniformity problems result in uneven surfaces and layers that are not uniformly thick. This is a significant problem for achieving complete planarization.

Therefore, there is a need in the art to provide a CMP system and process that overcomes the problems of uneven surfaces and increases the degree of long range planarization.

SUMMARY OF THE INVENTION

The above mentioned problems are addressed by the present subject matter and will be understood by reading and studying the following specification. The present subject matter provides chemical mechanical polishing (CMP) systems and methods that use a polishing pad drum. A platen holds a wafer to be polished. The polishing pad drum has a generally cylindrical shape and rotates along an axis of the cylinder. According to one embodiment, the platen linearly moves the wafer into contact with the polishing pad drum. This linear motion is characterized as being perpendicular or generally perpendicular (albeit in a different plane) to the axis of rotation of the polishing pad drum. In other words, the vector that represents the relative linear motion of the wafer with respect to the polishing pad drum lies in a plane and can be projected on a parallel plane that includes the axis of rotation of the polishing pad. This projection of the linear motion vector is perpendicular, or generally perpendicular, to the axis of rotation. This polishing system is capable of significantly increasing the degree of long range planarization by reducing uniformity problems such as dishing and rounding of the features.

One aspect of the present subject matter is a polishing system. One polishing system embodiment includes a platen adapted to receive a wafer, and a polishing pad drum that has a cylindrical, or generally cylindrical, shape with a length and an axis of rotation along the length. The polishing pad drum and the platen are adapted to be operably positioned a predetermined distance from each other in preparation to polish a surface of the wafer. The polishing pad drum is adapted to rotate about the axis of rotation along the drum length. The polishing pad drum, the platen, or both the polishing pad drum and the platen are adapted to be linearly moved to polish the surface of the wafer using the rotating polishing pad drum.

According to one embodiment, the polishing system includes a controller, a platen adapted to receive a wafer, a polishing pad drum, and a drive assembly coupled to the controller. The controller and drive assembly cooperate with each other to rotate the polishing pad drum and to operably move the polishing pad drum, the platen, or both the polishing pad drum and the platen to create a relative linear motion to polish the wafer.

According to one embodiment, the polishing system includes a controller, a platen adapted to receive a wafer, a polishing pad drum, a drive assembly coupled to the controller, and a trimming laser coupled to the controller. The controller and drive assembly along with the drive assembly for the laser are so controlled that the change in the diameter of the polishing drum, with the dressing operation, is accounted for in the vertical positioning of the platen. Thus, a specified thickness of material may be precisely removed.

One aspect of the present subject matter is a method for planarizing a wafer. According to this method, the wafer is positioned on a platen, and a polishing pad drum is rotated. A linear movement is created between the polishing pad drum and the platen to polish the wafer.

One aspect of the present subject matter is a process. According to one process embodiment, a polishing pad drum is dressed and a wafer is positioned on a platen. The polishing pad drum and the platen are set to be separated by a predetermined distance. This predetermined distance provides the desired separation between the wafer and the polishing pad drum for a polishing process. This predetermined distance may be characterized as a predetermined minimum distance between the polishing pad drum and the platen as they pass each other. The wafer is polished by rotating the polishing pad drum and creating a linear movement between the polishing pad drum and the platen. The wafer is removed from the platen, and a semiconductor fabrication process is performed on the wafer.

These and other aspects, embodiments, advantages, and features will become apparent from the following description of the invention and the referenced drawings.

DETAILED DESCRIPTION OF THE INVENTION

Figure 1:
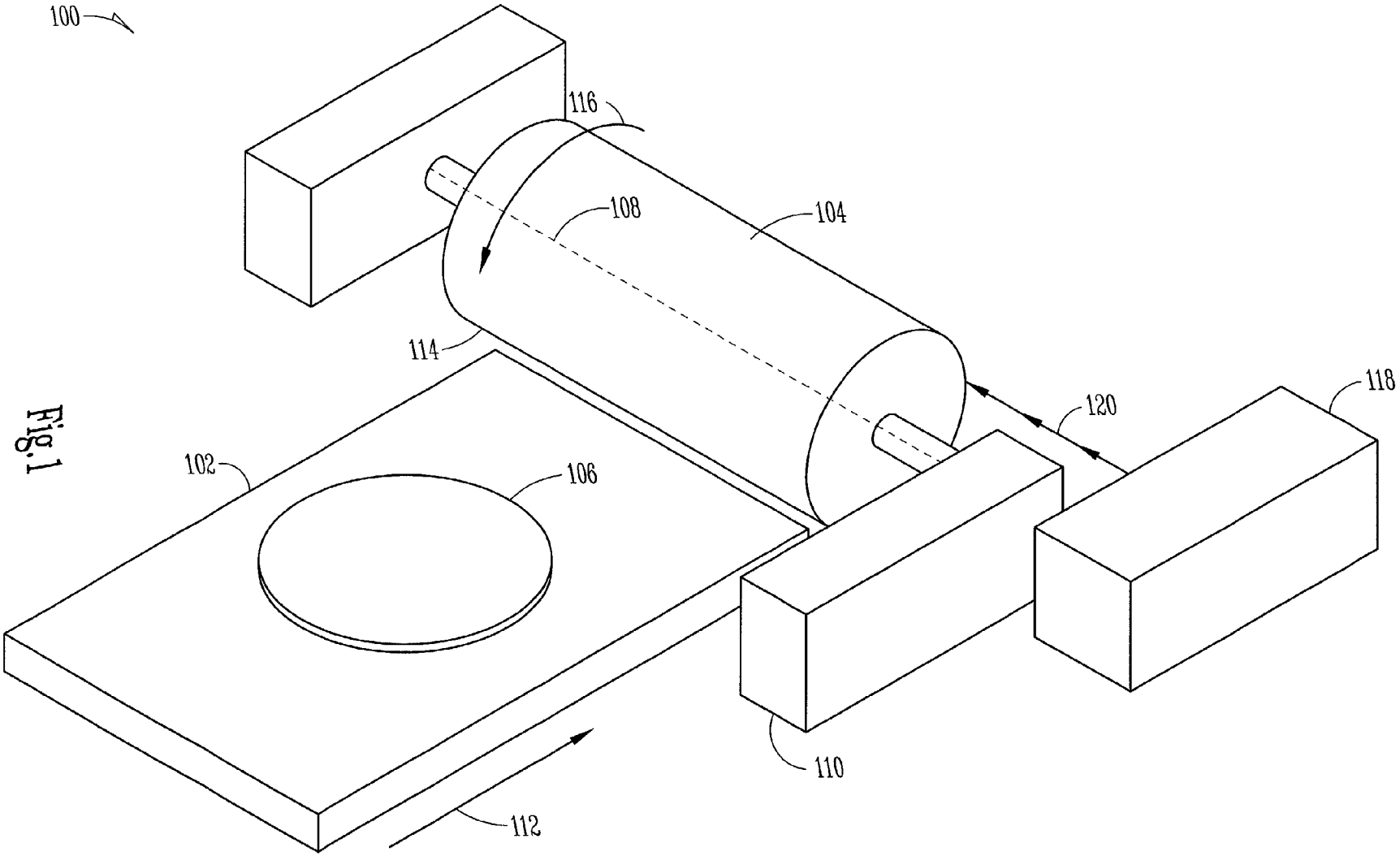
FIG. 1 is a perspective view of one chemical mechanical polishing (CMP) system embodiment.

The following detailed description of the invention refers to the accompanying drawings which show, by way of illustration, specific aspects and embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention. The following detailed description is, therefore, not to be taken in a limiting sense, and the scope of the present invention is defined only by the appended claims, along with the full scope of equivalents to which such claims are entitled.

The present subject matter provides chemical mechanical polishing (CMP) systems and methods in which a rotating polishing pad drum is used to polish a wafer held by a platen. The polishing pad drum operably contacts the wafer through a relative linear movement between the wafer and the rotating polishing pad drum. The linear motion is characterized as being perpendicular (albeit in a different plane) to the axis of rotation of the polishing drum, which significantly increases the degree of long range planarization by reducing uniformity problems such as dishing and rounding of the features.

FIG. 1 is a perspective view of one chemical mechanical polishing (CMP) system embodiment. The illustrated embodiment of the CMP system 100 includes a platen 102 and a polishing pad drum 104.

According to one embodiment, the polishing pad drum 104 is formed in the shape of a cylinder or drum. According to another embodiment, the polishing pad drum 104 includes a drum center and a polishing pad attached around the drum center.

According to one embodiment, the polishing pad drum 104 is rigid. In this embodiment, for example, a soft backing material is not used in the polishing pad.

A CMP process uses a polishing agent that is, at least to some extent, generally reactive to the materials being processed. According to one embodiment, a polishing abrasive is embedded in the polishing pad drum 104. Another embodiment provides the polishing abrasive separately in a slurry.

A semiconductor wafer 106 is placed on or is otherwise received by the platen 102. The polishing pad drum 104 has a length that preferably spans across the width of the wafer 106. The polishing pad drum 104 has an axis of rotation 108 along the length of the polishing pad drum 104. A motor drive 110 rotates the polishing pad drum 104 about the axis of rotation 108. By having a length that spans across the entire width of the wafer 106, the rotating polishing pad drum 104 is able to process the entire wafer 106 in one pass.

The polishing pad drum 104 and the platen 102 are adapted to have a relative linear movement with respect to each other. In the illustrated CMP system 100, the relative linear motion is represented by arrow 112. According to one embodiment, the platen 102 is moved in the direction of arrow 112 to provide the relative linear motion. As will be apparent to one of ordinary skill in the art upon reading and understanding this disclosure, the CMP system 100 may be designed such that the relative linear motion between the platen 102 and the polishing pad drum 104 may be achieved by moving the platen 102 as shown, by moving the polishing pad drum 104, or by moving both the polishing pad drum 104 and the platen 102.

If the directional vector represented by the arrow 112 and the axis of rotation 108 of the polishing pad drum 104 were coplanar, the directional vector 112 would be perpendicular, or generally perpendicular, to the axis of rotation 108. That is, a projection of the direction vector 112 onto a parallel plane that includes the axis of rotation 108 is perpendicular, or generally perpendicular, to the axis of rotation.

It is noted that there is a predetermined separation between the platen 102 and the polishing pad drum 104 such that the wafer 106 can fit between the platen 102 and polishing pad drum 104 for a CMP process. This predetermined separation can be characterized as a predetermined minimum distance between the polishing pad drum 104 and the platen 102 as the polishing pad drum 104 and the platen 102 pass each other due to the linear motion. In other words, there is a distance between the polishing pad drum 104 and the platen 102. As the polishing pad drum 104 and the platen 102 move toward each other, the distance between the two becomes less and less until they are a predetermined minimum distance from each other.

The rotation of the polishing pad drum 104 produces a tangential force between the platen 102 and the polishing pad drum 104. The rotation of the polishing pad drum is represented by arrow 116. This tangential force represents the polishing force produced by a wafer contact portion 114 of the rotating polishing pad drum 104. According to one embodiment, the direction of the rotation of the polishing pad drum 104 is such that the tangential force between the platen 102 and the polishing pad drum 104 is in the same direction as the motion of the platen 102. In this embodiment, any debris produced by the CMP process is thrown in a direction so as not to interfere with the ongoing CMP process; that is, the debris is not thrown toward the unprocessed portions of the wafer 106. The direction, speed and timing of the motions may be varied for various CMP system designs.

The illustrated embodiment of the CMP system 100 also includes a planarizing system 118 used to dress the polishing pad drum 104. According to one embodiment, the planarizing system 118 includes a laser that has a finely tuned laser beam 120 to appropriately dress the surface of the polishing pad drum 104. Dressing the surface of the polishing pad drum 104 involves providing the cylindrically-shaped polishing pad drum 104 with a smooth or uniform surface such that the polishing pad drum 104 has a uniform diameter along its length.

Figure 2:
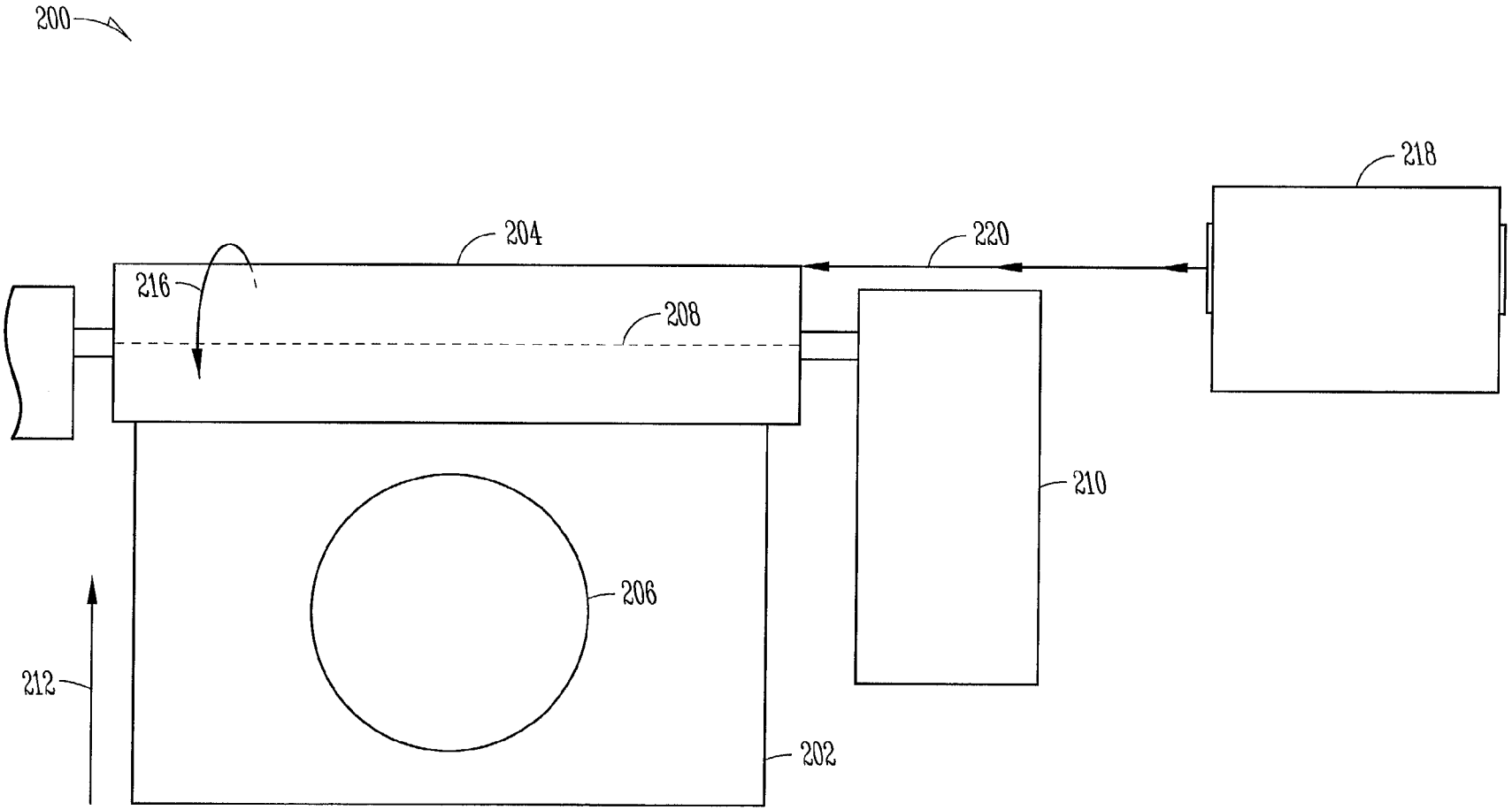
FIG. 2 is top view of the CMP system of FIG. 1.

FIG. 2 is top view of the CMP system of FIG. 1. The system 200 includes a platen 202, a polishing pad drum 204, a motor drive 210 and a planarizing system 218. In this view of the embodiment, the wafer 206 is being carried by the platen 202 underneath the polishing pad drum 204. The motor drive 210 rotates the polishing pad drum 204 in a direction that throws debris from a CMP process in a direction along the linear movement of the platen 202 such that the debris will not interfere with the ongoing CMP process. The planarizing system 218 includes a laser that has a laser beam 220 that is adapted to dress the polishing pad drum 204 as needed. According to this embodiment, the relative position between the drum 204 and the beam 220 is changed during operation and the magnitude of the change is sensed by the controller.

Figure 3:
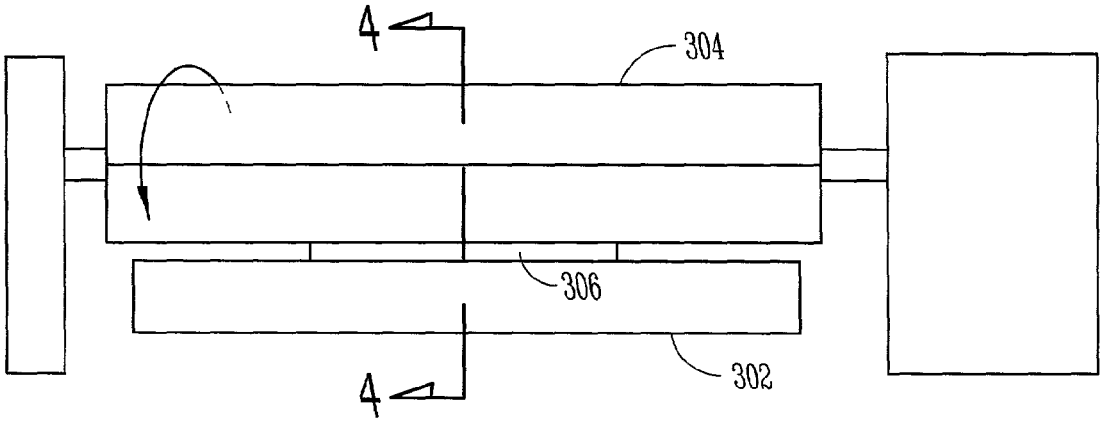
FIG. 3 is a front view of the CMP system of FIG. 1.

FIG. 3 is a front view of the CMP system of FIG. 1. In this view, the wafer 306 is shown as being disposed in between the platen 302 and the polishing pad drum 304. The wafer 306 is shown as being moved by the platen 302 into the page.

Figure 4:
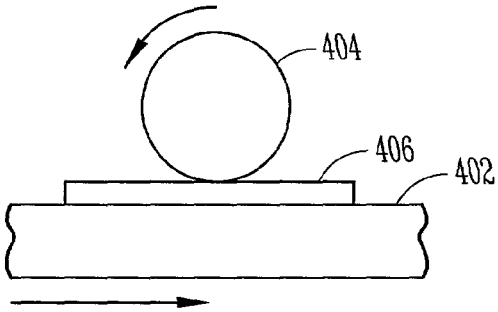
FIG. 4 is a cross-section view along line 4—4 of the CMP system shown in FIG. 3.

FIG. 4 is a cross-section view along line 4—4 of the CMP system shown in FIG. 3. In this view, the wafer 406 is shown as being disposed in between the platen 402 and the polishing pad drum 404. The wafer 406 is shown as being moved by the platen 402 to the right. It is apparent from this view of this embodiment that the debris from the CMP process is directed in the direction of relative motion of the wafer 406 with respect to the polishing pad drum 404.

Figure 5:
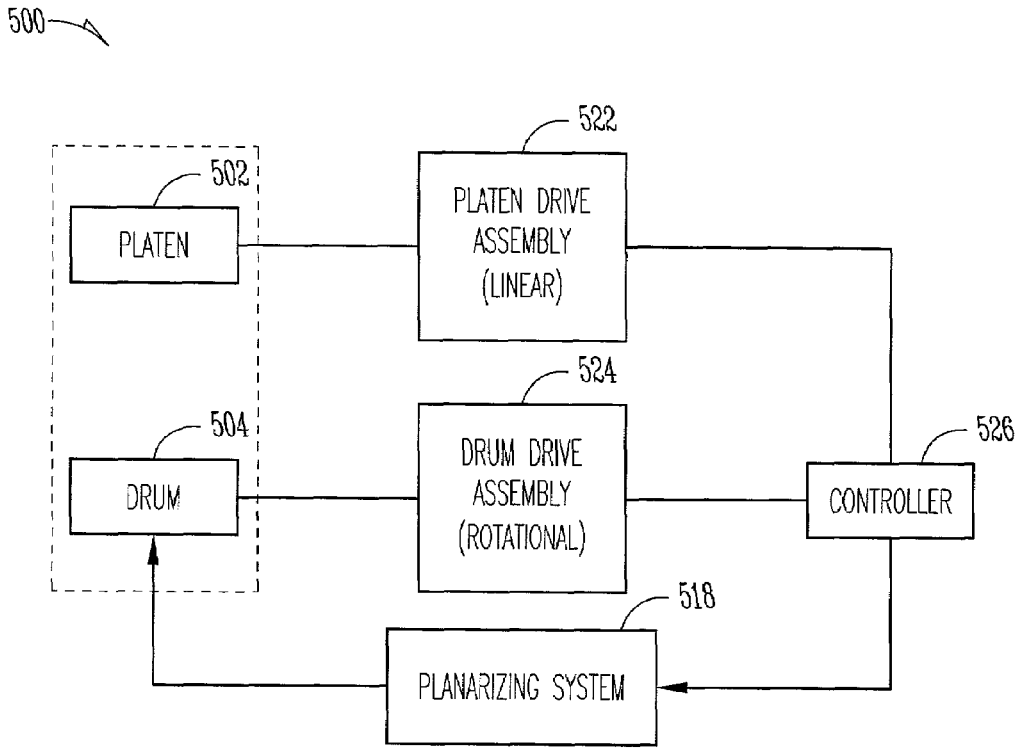
FIG. 5 is a block diagram of one CMP system embodiment.

FIG. 5 is a block diagram of one CMP system embodiment. According to this embodiment, the CMP system 500 includes a platen 502 and a polishing pad drum 504. The platen 502 is adapted to be linearly moved, and the polishing pad drum 504 is adapted to be rotationally moved. A platen drive assembly 522 controls the linear movement of the platen and a drum drive assembly 524 controls the rotational movement of the polishing pad drum 504. A controller 526 is coupled to and in communication with the platen drive assembly 522 and the drum drive assembly 524 and the planarizing system 518 which, according to one embodiment, includes a trimming laser.

As is apparent to one of ordinary skill in the art, the controller 526 may be hardware, software, or a combination thereof. The controller 526 controls the operation of the drive assemblies 522 and 524, and thus the movements of the platen 502 and the polishing pad drum 504. According to various embodiments, the controller 526 and the drive assemblies 522 and 524 cooperate to control the direction, speed and/or timing of the movements of the platen 502 and the polishing pad drum 504.

The illustrated CMP system 500 also includes a planarizing system 518 for dressing the polishing pad drum 504. The controller 526 is also coupled to and in communication with the planarizing system 518 to control the process of dressing the polishing pad drum 504.

Figure 6:
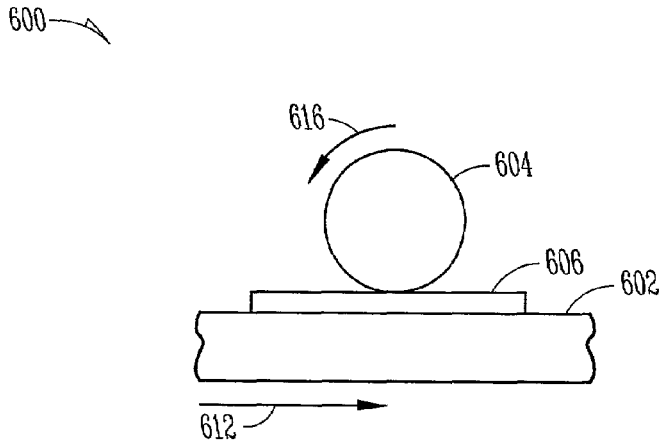
FIG. 6 is a side view of the CMP system of FIG. 5, illustrating the motion of the drum and the platen.

FIG. 6 is a side view of the CMP system of FIG. 5, illustrating the motion of the drum and the platen. According to this system embodiment 600, the relative linear movement 612 between the polishing pad drum 604 and the platen 602 is attributable to the platen drive assembly 522 of FIG. 5, which linearly moves the platen 602 with respect to the drum 604. The rotational movement 616 is attributable by the drum drive assembly 524 of FIG. 5.

Figure 7:
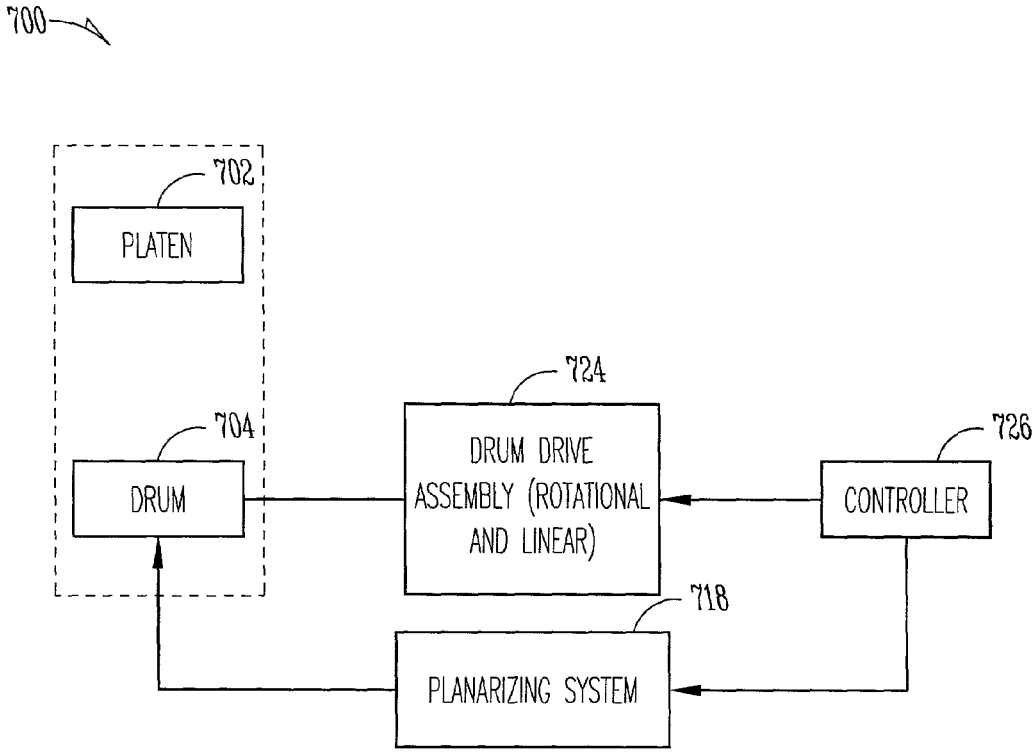
FIG. 7 is a block diagram of one CMP system embodiment.

FIG. 7 is a block diagram of one CMP system embodiment. According to this embodiment, the CMP system 700 includes a platen 702 and a polishing pad drum 704. The polishing pad drum 704 is adapted to be linearly and rotationally moved. A drum drive assembly 724 controls both the linear movement the rotational movement of the polishing pad drum 704. A controller 726 is coupled to and in communication with the drum drive assembly 724. According to various embodiments, the controller 726 and drum drive assembly 724 cooperate to control the direction, speed and/or timing of the movements of the polishing pad drum 704. The illustrated CMP system embodiment also includes a planarizing system 718 for dressing the polishing pad drum 704. The controller 726 is also coupled to and in communication with the planarizing system 718 to control the process of dressing the polishing pad drum 704.

Figure 8:
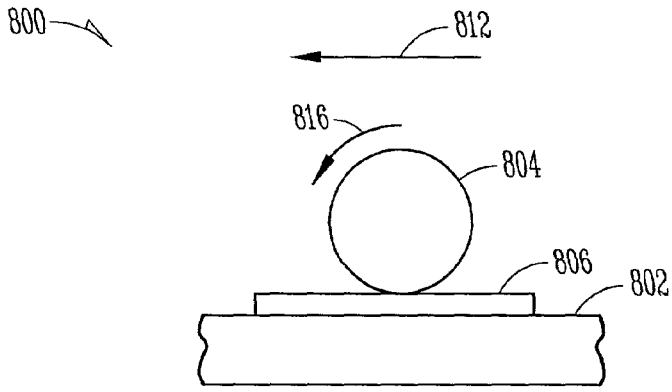
FIG. 8 is a side view of the CMP system of FIG. 7, illustrating the motion of the drum and the platen.

FIG. 8 is a side view of the CMP system of FIG. 7, illustrating the motion of the drum and the platen. According to this system embodiment 800, the relative linear movement between the polishing pad drum 804 and the platen 802 is accomplished by the drum drive assembly 724 of FIG. 7, which linearly moves the polishing pad drum 804 in the direction of linear motion arrow 812 with respect to the platen 802. The rotational motion, represented by arrow 816, of the polishing pad drum 804 also is accomplished by the drum drive assembly 724 of FIG. 7.

Figure 9:
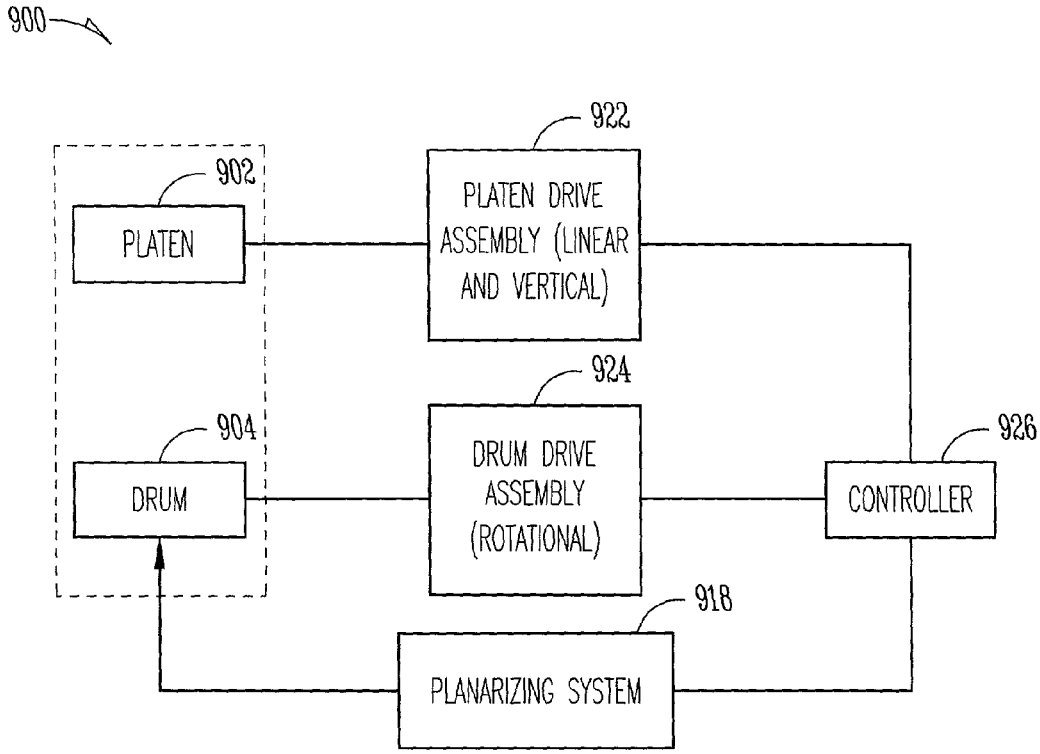
FIG. 9 is a block diagram of one CMP system embodiment.

FIG. 9 is a block diagram of one CMP system embodiment. According to this embodiment, the CMP system 900 includes a platen 902 and a polishing pad drum 904. The polishing pad drum 904 is adapted to be rotationally moved. A drum drive assembly 924 controls the rotational movement of the polishing pad drum 904. A controller 926 is coupled to and in communication with the drum drive assembly 924. According to various embodiments, the controller 926 and drum drive assembly 924 cooperate to control the direction, speed and/or timing of the rotational movement of the polishing pad drum 904.

According to this embodiment, a platen drive assembly 922 controls the linear and vertical movement of the platen 902. The term "vertical movement" represents movement that is orthogonal to the linear movement and that provides the predetermined distance, or predetermined minimum distance, between the platen 902 and the polishing pad drum 904 as the platen 902 and the polishing pad drum 904 pass each other during the linear movement. That is, there is a distance between the platen 902 and the polishing pad drum 904, and this distance decreases during the linear movement as the polishing pad drum 904 and the platen approach each other until the predetermined minimum distance is achieved. During a CMP process, the polishing pad drum 904 contacts the wafer at this point. The term "vertical movement" is not intended to be limited to a particular orientation.

This predetermined minimum distance is variable. Thus, the CMP process is capable of being performed on the various layers built on the wafer during the fabrication process. The platen drive assembly 922 is capable of controlling this predetermined minimum distance. One of ordinary skill in the art will understand, upon reading and comprehending this disclosure, that the drum drive assembly 924 may be moved to control the predetermined minimum distance between the platen 902 and the polishing drum 904.

The illustrated CMP system embodiment 900 also includes a planarizing system 918 for dressing the polishing pad drum 904. The controller 926 is also coupled to and in communication with the planarizing system 918 to control the process of dressing the polishing pad drum 904. The controller 926 vertically moves the wafer platen 902 to compensate for changes in the diameter of the drum 904 caused by the dressing operation. One of ordinary skill in the art will understand, upon reading and comprehending this disclosure, that in various embodiments, the controller 926 vertically moves the drum 904 and/or the platen 902 to compensate for changes in the diameter of the drum 904 caused by the dressing operation.

Figure 10:
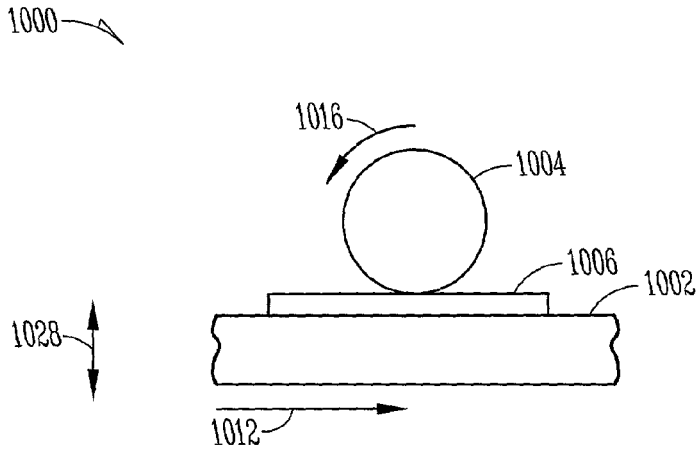
FIG. 10 is a side view of the CMP system of FIG. 9, illustrating the motion of the drum and the platen.

FIG. 10 is a side view of the CMP system of FIG. 9, illustrating the motion of the drum and the platen. According to this system embodiment 1000, the rotational motion, represented by arrow 1016, of the polishing pad drum 1004 is accomplished by the drum drive assembly 924 of FIG. 9. The relative linear movement between the polishing pad drum 1004 and the platen 1002 is accomplished by the platen drive assembly 922 of FIG. 9, which linearly moves the platen 1002 in the direction of linear motion arrow 1012 with respect to the platen 1002. Furthermore, the vertical movement that provides the predetermined minimum distance between the polishing pad drum 1004 and the platen 1002 is accomplished by the platen drive assembly 922 of FIG. 9, which moves the platen 1002 as represented by vertical motion arrow 1028 with respect to the platen 1002.

Figure 11:
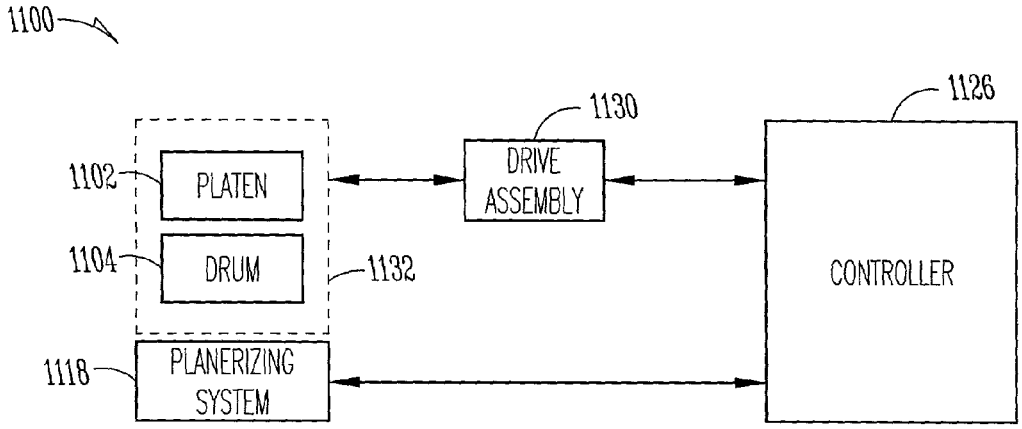
FIG. 11 is a block diagram of one CMP system embodiment.

FIG. 11 is a block diagram of one CMP system embodiment. According to this embodiment, the CMP system 1100 includes a platen 1102 and a polishing pad drum 1104. The polishing pad drum 1104 is adapted to be rotationally moved. A drive assembly 1130 controls the rotational movement of the polishing pad drum 1104. Additionally, the drive assembly 1130 is adapted to control the relative linear motion and vertical motion between the platen 1102 and the polishing pad drum 1104. As was pointed out above, this relative motion can be accomplished either by moving the platen 1102 or the polishing pad drum 1104. This relationship is illustrated in FIG. 11 by the dotted line 1132 that groups the platen 1102 and polishing pad drum 1104. A controller 1126 is coupled to or in communication with the drive assembly 1130. According to various embodiments, the controller 1126 and the drive assembly 1130 cooperate to control the direction, speed and/or timing of the various motions of the platen 1102 and the polishing pad drum 1104. The illustrated CMP system embodiment 1100 also includes a planarizing system 1118 for dressing the polishing pad drum 1104. The controller 1126 is also coupled to and in communication with the planarizing system 1118 to control the process of dressing the polishing pad drum 1104.

Figure 12:
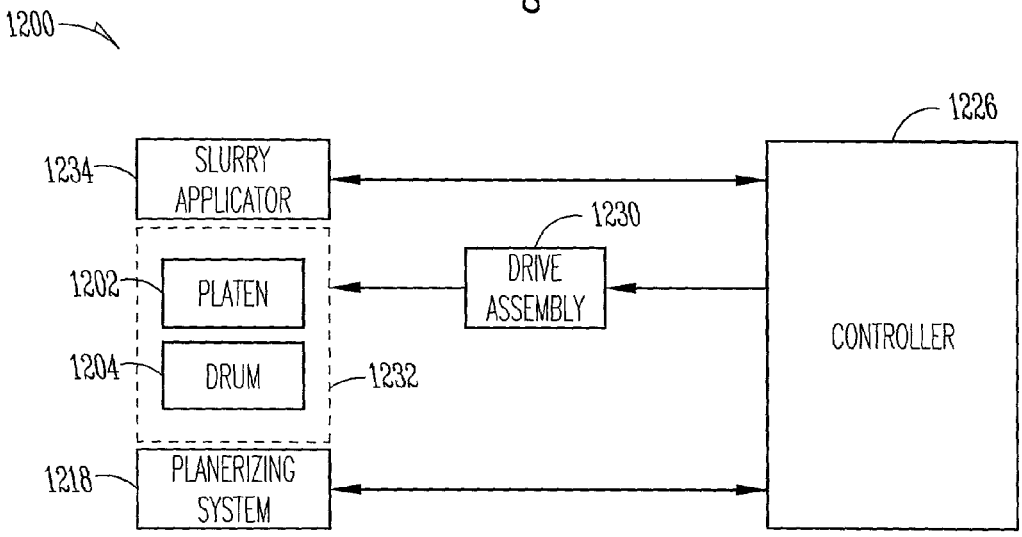
FIG. 12 is a block diagram of another CMP system embodiment.

FIG. 12 is a block diagram of another CMP system embodiment. According to this embodiment, the CMP system 1200 includes a platen 1202 and a polishing pad drum 1204. The polishing pad drum 1204 is adapted to be rotationally moved. A drive assembly 1230 controls the rotational movement of the polishing pad drum 1204. Additionally, the drive assembly 1230 is adapted to control the relative linear motion and vertical motion between the platen 1202 and the polishing pad drum 1204, as represented by the dotted line 1232. A controller 1226 is coupled to or in communication with the drive assembly 1230. According to various embodiments, the controller 1226 and the drive assembly 1230 cooperate to control the direction, speed and/or timing of the various motions of the platen 1202 and the polishing pad drum 1204.

The illustrated CMP system embodiment 1200 also includes a planarizing system 1218 for dressing the polishing pad drum 1204 and a slurry applicator 1234 for applying a slurry used in a CMP process. The controller 1226 is also coupled to and in communication with the planarizing system 1218 and the slurry applicator 1234 to control the process of dressing the polishing pad drum 1204 and the process of applying a slurry.

Figure 13:
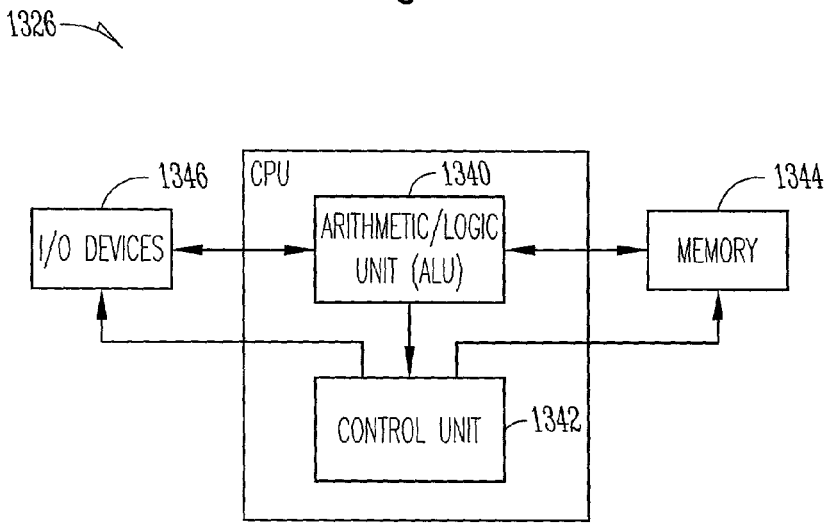
FIG. 13 is a block diagram of one embodiment of an electronic system used as a controller for a CMP system.

FIG. 13 is a block diagram of one embodiment of an electronic system used as a controller for a CMP system. FIG. 13 is a simplified block diagram of a high-level organization of an electronic system 1326. According to one embodiment, the electronic system 1326 functions as a controller in a CMP process. The electronic system 1326 has functional elements, including an arithmetic/logic unit (ALU) or processor 1340, a control unit 1342, a memory device unit 1344, and an input/output (I/O) device 1346. Generally such an electronic system 1326 will have a native set of instructions that specific operations to be performed on data by the ALU 1340 and other interactions between the ALU 1340, the memory device unit 1344 and the I/O devices 1346. The memory device unit 1344 contains the data plus a stored list of instructions. The control unit 1342 coordinates all operations of the processor 1340, the memory device 1344 and the I/O devices 1346 by continuously cycling through a set of operations that cause instructions to be fetched from the memory device 1344 and executed. These executed instructions include sending and receiving signals such as control, communication, data and sensor signals.

The figures presented and described in detail above are similarly useful in describing the method aspects of the present subject matter. The methods described below are nonexclusive as other methods may be understood from the specification and the figures described above.

Figure 14:
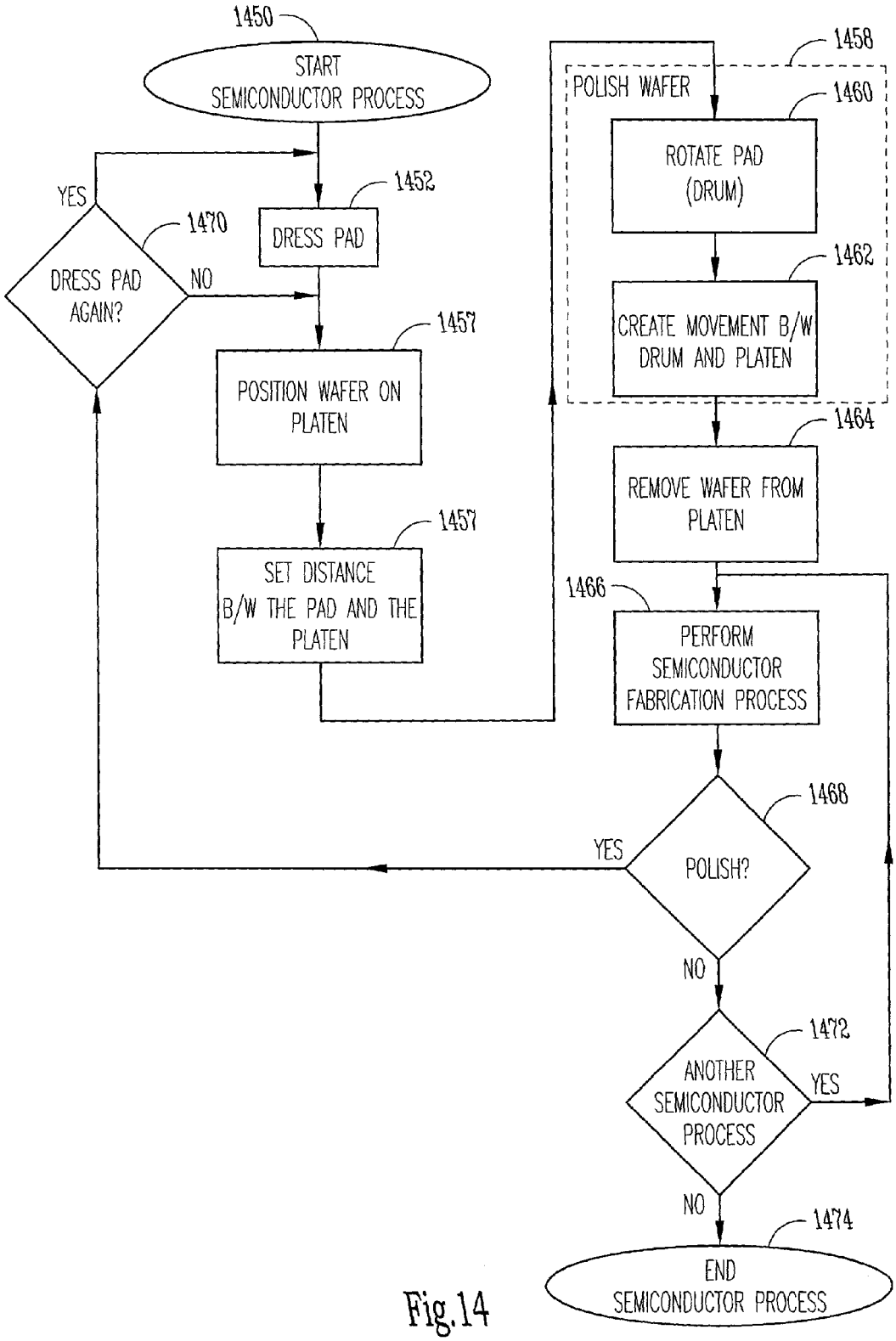
FIG. 14 is a flowchart illustrating one embodiment of a semiconductor process that incorporates one embodiment of a CMP process.

FIG. 14 is a flowchart illustrating one embodiment of a semiconductor process that incorporates one embodiment of a CMP process. The process begins at 1450. The pad, or polishing pad drum, is dressed at 1452 to ensure that the drum has a planar surface. One method for dressing the pad uses a finely tuned laser beam.

Wafers are initially polished to achieve a planar surface upon which the various layers for each wafer are formed. As it is at this time impractical to achieve a completely parallel top surface with respect to the bottom surface, the wafer may have a slight non planar top surface when referenced to the bottom surface of the wafer. A normal semiconductor process is run after the wafer is initially polished.

At 1454, the wafer is positioned or mounted on the platen such that it is capable of being positioned in a consistent position relative to the platen each time that it is polished. The distance between the platen and the polishing pad drum is adjusted or set at 1456 so as to accommodate the thickness of each successive layer built on the wafer during the fabrication process. This distance represents the predetermined minimum distance between the platen and the polishing pad drum as the platen and polishing pad drum pass each other.

At 1458, the wafer is polished. The wafer is polished by rotating the polishing pad drum at 1460 and by creating a linear movement between the drum and the platen at 1462. After the polishing process, the wafer is removed from the platen at 1464, and semiconductor fabrication processes are performed on the wafer at 1466. These semiconductor fabrication processes include, but are not limited to, processes that are used in the damascene process described earlier in this disclosure in the section entitled Background of the Invention.

After the semiconductor fabrication process, at 1468, it is determined whether the surface of the wafer is to be polished. For example, in the damascene process, the wafer is polished after the copper is blank deposited. If the surface of the wafer is to be polished, the process proceeds to 1470 where it is determined whether the polishing pad drum should be dressed again. If the drum should be dressed, the process proceeds back to 1452. If the drum does not need to be dressed, the process proceeds back to 1454. If, at 1468, it is determined that the surface of the wafer is not to be polished, the process proceeds to 1472 where it is determined whether another semiconductor process is to be performed. If it is determined that another semiconductor process is to be performed, then the process proceeds back to 1466. If it is determined that another semiconductor process is not to be performed, the process continues to 1474 where the semiconductor process terminates.

Figure 15:
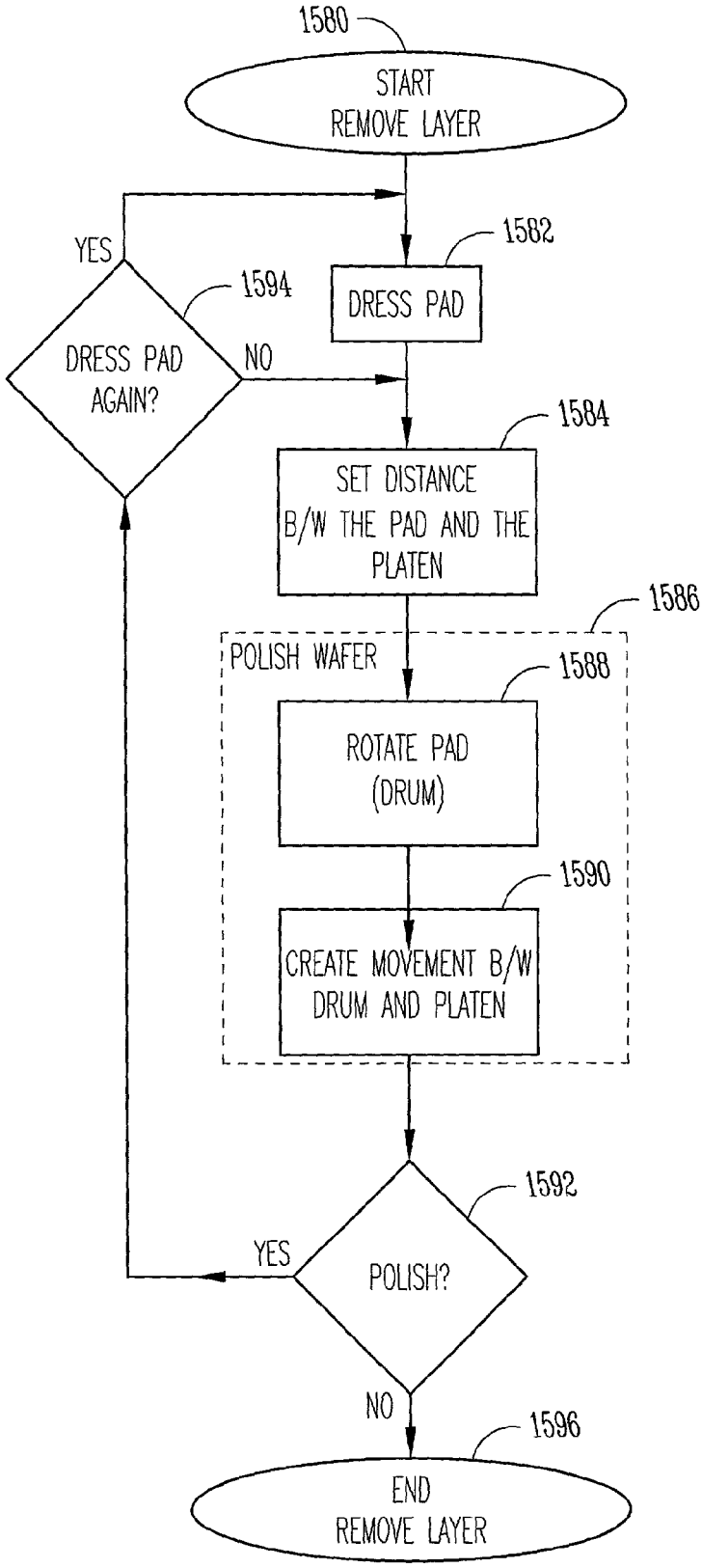
FIG. 15 is a flowchart illustrating one embodiment of a process for removing a semiconductor layer.

FIG. 15 is a flowchart illustrating one embodiment of a process for removing a semiconductor layer. This process recognizes that a single layer often will have an uneven surface characterized with peaks. A pass of the polishing pad with respect to the wafer removes the peaks, or a portion of the peaks. The peaks of the wafer surface may cause the polishing pad to wear unevenly. As such, it may be desirable to dress the pad between polishing passes. The removal of a single layer may require several polishing passes and several dressings of the polishing pad.

According to the illustrated embodiment, the process for removing a semiconductor layer begins at 1580. The pad, or polishing pad drum, is dressed at 1582 to ensure that the drum has a planar surface. One method for dressing the pad uses a finely tuned laser beam. The distance between the platen and the polishing pad drum is adjusted or set at 1584 so as to accommodate the thickness of each successive layer built on the wafer during the fabrication process. This distance represents the predetermined minimum distance between the platen and the polishing pad drum as the platen and polishing pad drum pass each other.

At 1586, the wafer is polished. The wafer is polished by rotating the polishing pad drum at 1588 and by creating a linear movement between the drum and the platen at 1590. At 1592, it is determined whether the surface of the wafer is to be polished again. If the surface of the wafer is to be polished, the process proceeds to 1594 where it is determined whether the polishing pad drum should be dressed again. If the drum should be dressed, the process proceeds back to 1582. If the drum does not need to be dressed, the process proceeds back to 1584. If, at 1592, it is determined that the surface of the wafer is not to be polished, the process proceeds to 1596 where the process for removing a semiconductor layer terminates.

CONCLUSION

The present subject matter provides chemical mechanical polishing (CMP) systems and methods in which a rotating polishing pad drum is used to polish a surface of a wafer held by a platen. The polishing pad drum operably contacts the wafer through a relative linear movement between the wafer and the rotating polishing pad drum. The linear motion is perpendicular (albeit in a different plane) to the axis of rotation of the polishing pad drum. That is, the relative linear motion is characterized by a linear motion vector. A projection of this linear motion vector into a parallel plane that contains the axis of rotation for the polishing pad drum is perpendicular, or generally perpendicular, to the axis of rotation. The CMP systems and processes described herein significantly increase the degree of long range planarization by reducing uniformity problems such as dishing and rounding of the features. The result is that each polished layer has a surface or thickness that is substantially uniform through the layer.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. A polishing system, comprising:

a platen adapted to receive a wafer; and a polishing pad drum having a cylindrical shape with a length and an axis of rotation along the length, the polishing pad drum being formed by a rigid polishing pad, wherein the polishing pad drum is adapted to rotate about the axis of rotation along the drum length, and wherein at least one of the polishing pad drum and the platen are adapted to be linearly moved with respect to the other to move the wafer with respect to the polishing pad drum in a direction to throw debris in a direction toward a previously processed portion of the wafer.

2. The polishing system of claim 1, wherein the platen is adapted to be linearly moved with respect to the polishing pad.

3. The polishing system of claim 1, wherein the polishing pad drum is adapted to be linearly moved with respect to the platen.

4. The polishing system of claim 1, wherein the polishing pad drum is adapted to be moved to provide a predetermined minimum distance between the polishing pad drum and the platen as the polishing pad drum and the platen pass each other due to the linear motion.

5. The polishing system of claim 1, wherein the platen is adapted to be moved to provide a predetermined minimum distance between the polishing pad drum and the platen as the polishing pad drum and the platen pass each other due to the linear motion.

6. The polishing system of claim 1, wherein the polishing pad drum is embedded with a polishing abrasive.

7. The polishing system of claim 1, further comprising a slurry applicator adapted to provide a slurry on the wafer.

8. The polishing system of claim 1, wherein the length of the polishing pad drum spans across the wafer to polish the wafer in one pass, a tangential force between the polishing pad drum and the platen is produced when the polishing pad drum is rotated, and wherein at least one of the polishing pad drum and the platen are adapted to be linearly moved with respect to the other to move the wafer with respect to the polishing pad drum in the direction of the tangential force to throw debris in a direction toward a previously processed portion of the wafer to avoid interfering with polishing during the one pass.

9. The polishing system of claim 1, wherein the linear movement of at least one of the polishing pad drum and the platen is capable of being represented by a linear motion vector, wherein the linear motion vector is capable of being projected onto a parallel plane that contains the axis of rotation of the polishing pad drum, and wherein the projected linear motion vector is generally perpendicular to the axis of rotation.

10. The polishing system of claim 1, further comprising a finely tuned laser beam adapted to dress the polishing pad drum.

11. A polishing system, comprising:

a platen adapted to receive a wafer;

a polishing pad drum having a cylindrical shape with a length and an axis of rotation along the length, the polishing pad drum being formed by a rigid polishing pad; and a planarizing system adapted to dress the polishing pad drum, wherein the polishing pad drum is adapted to rotate about the axis of rotation along the drum length, wherein at least one of the polishing pad drum and the platen are adapted to be linearly moved with respect to the other to polish the surface of the wafer while moving the wafer with respect to the polishing pad drum in a direction to throw debris in a direction toward a previously processed portion of the wafer, and wherein the polishing pad drum and the platen are adapted to be operably positioned to provide a predetermined minimum distance between the polishing pad drum and the platen as the polishing pad drum and the platen pass each other due to the linear motion.

12. The polishing system of claim 11, wherein the planarizing system includes a finely tuned laser beam adapted to dress the polishing pad drum.

13. The polishing system of claim 11, wherein the platen is adapted to be linearly moved with respect to the polishing pad drum.

14. The polishing system of claim 11, wherein the polishing pad drum is adapted to be linearly moved with respect to the platen.

15. The polishing system of claim 11, wherein the polishing pad drum is embedded with a polishing abrasive.

16. The polishing system of claim 11, further comprising a slurry applicator adapted to provide a slurry on the wafer.

17. The polishing system of claim 11, wherein the length of the polishing pad drum spans across the wafer to polish the wafer in one pass, a tangential force between the drum and the platen is produced when the drum is rotated, and wherein at least one of the polishing pad drum and the platen are adapted to be linearly moved with respect to the other so as to move the wafer with respect to the polishing pad drum in the direction of the tangential force to throw debris in a direction toward a previously processed portion of the wafer to avoid interfering with polishing during the one pass.

18. The polishing system of claim 11, wherein the linear movement of at least one of the polishing pad drum and the platen is capable of being represented by a linear motion vector, wherein the linear motion vector is capable of being projected onto a parallel plane that contains the axis of rotation of the polishing pad drum, and wherein the projected linear motion vector is generally perpendicular to the axis of rotation.

19. The polishing system of claim 11, wherein the polishing pad drum is adapted to be moved to provide the predetermined minimum distance and to compensate for a drum diameter loss due to a dressing operation performed by the planarizing system on the polishing pad drum.

20. The polishing system of claim 11, wherein the platen is adapted to be moved to provide the predetermined minimum distance and to compensate for a drum diameter loss due to a dressing operation performed by the planarizing system on the polishing pad drum.

21. A polishing system, comprising:

a platen adapted to receive a wafer;

a rigid polishing pad formed into a polishing pad drum that has a generally cylindrical shape with a length and an axis of rotation along the length; and a finely tuned laser beam adapted to dress the polishing pad drum, wherein the polishing pad drum is adapted to rotate about the axis of rotation along the drum length, wherein at least one of the polishing pad drum and the platen are adapted to be linearly moved with respect to the other, wherein the polishing pad drum and the platen are adapted to be operably positioned to provide a predetermined minimum distance between the polishing pad drum and the platen as the polishing pad drum and the platen pass each other due to the linear motion, wherein the length of the polishing pad drum spans across the wafer to polish the wafer in one pass, wherein a tangential force between the drum and the platen is produced when the drum is rotated, and wherein at least one of the polishing pad drum and the platen are adapted to be linearly moved with respect to the other to move the wafer with respect to the polishing pad drum in the direction of the tangential force to throw debris in a direction toward a previously processed portion of the wafer to avoid interfering with polishing during the one pass.

22. The polishing system of claim 21, wherein the platen is adapted to be linearly moved with respect to the polishing pad.

23. The polishing system of claim 21, wherein the polishing pad drum is adapted to be linearly moved with respect to the platen.

24. The polishing system of claim 21, wherein the polishing pad drum is adapted to be moved to provide the predetermined minimum distance and to compensate for a drum diameter loss due to a dressing operation performed by the planarizing system on the polishing pad drum.

25. The polishing system of claim 21, wherein the platen is adapted to be moved to provide the predetermined minimum distance and to compensate for a drum diameter loss due to a dressing operation performed by the planarizing system on the polishing pad drum.

26. The polishing system of claim 21, wherein the polishing pad drum is embedded with a polishing abrasive.

27. The polishing system of claim 21, further comprising a slurry applicator adapted to provide a slurry on the wafer.

28. A polishing system, comprising:

a controller;

a platen adapted to receive a wafer;

a polishing pad drum having a cylindrical shape with a length and an axis of rotation along the length, the polishing pad drum being formed by a rigid polishing pad; and a drive assembly coupled to the controller and adapted to rotate the drum and to linearly move at least one of the polishing pad drum and the platen to polish the wafer while moving the wafer with respect to the polishing pad drum in a direction to throw debris in a direction toward a previously processed portion of the wafer.

29. The polishing system of claim 28, further comprising a laser beam adapted to dress the polishing pad drum.

30. The polishing system of claim 28, wherein the controller and the drive assembly are adapted to control a rotational direction of movement for the polishing pad drum.

31. The polishing system of claim 28, wherein the controller and the drive assembly are adapted to control a rotational speed of movement for the polishing pad drum.

32. The polishing system of claim 28, wherein the controller and the drive assembly are adapted to control a linear direction of movement for the polishing pad drum with respect to the platen.

33. The polishing system of claim 28, wherein the controller and the drive assembly are adapted to control a linear direction of movement for the platen with respect to the polishing pad drum.

34. The polishing system of claim 28, wherein the controller and the drive assembly are adapted to control a speed of linear movement for the platen with respect to the polishing pad drum.

35. The polishing system of claim 28, wherein the controller and the drive assembly are adapted to control a speed of linear movement for the polishing pad drum with respect to the platen.

36. The polishing system of claim 28, wherein the controller and the drive assembly are adapted to move the platen to provide a predetermined minimum distance with respect to the polishing pad drum when the polishing pad drum and the platen pass each other due to the linear motion.

37. The polishing system of claim 28, wherein the controller and the drive assembly are adapted to move the polishing pad drum to provide a predetermined minimum distance with respect to the polishing pad drum when the polishing pad drum and the platen pass each other due to the linear motion.

38. The polishing system of claim 28, wherein the linear motion of at least one of the polishing pad drum and the platen is capable of being represented by a linear motion vector, wherein the linear motion vector is capable of being projected onto a parallel plane that contains the axis of rotation of the polishing pad drum, and wherein the projected linear motion vector is generally perpendicular to the axis of rotation.

39. The polishing system of claim 28, wherein the control unit includes an electronic system comprising a control unit, a processor coupled to the control unit, a memory coupled to the control unit and the processor, and input/output devices coupled to the control unit and the processor.

40. A polishing system, comprising:

a controller;

a platen adapted to receive a wafer;

a polishing pad drum having a cylindrical shape with a length and an axis of rotation along the length, the polishing pad drum being formed by a rigid polishing pad;

a drive assembly coupled to the controller and adapted to rotate the drum and to linearly move at least one of the polishing pad drum and the platen to polish the wafer while moving the wafer with respect to the polishing pad drum in a direction to throw debris in a direction toward a previously processed portion of the wafer; and a planarizing system coupled to the controller and adapted to dress the polishing pad.

41. The polishing system of claim 40, wherein the drive assembly and controller are adapted to move at least one of the platen and the polishing pad drum to provide a predetermined minimum distance between each other when the polishing pad drum and the platen pass each other due to the linear motion, and wherein the controller is coupled to the planarizing system and is adapted to provide precise thickness control by coordinating a dressing operation performed on the polishing pad drum and the movement of at least one of the platen and the polishing pad drum.

42. A polishing system, comprising:

a controller;

a platen adapted to receive a wafer;

a polishing pad drum having a cylindrical shape with a length and an axis of rotation along the length, the polishing pad drum being formed by a rigid polishing pad;

a drum drive assembly coupled to the controller and adapted to rotate the drum; and a platen drive assembly coupled to the controller and adapted to linearly move the platen with respect to the polishing pad drum and further adapted to move the platen to provide a predetermined minimum distance with respect to the polishing pad drum when the polishing pad drum and the platen pass each other due to the linear motion, wherein the linearly moving platen moves the wafer with respect to the polishing pad drum in a direction to throw debris in a direction toward a previously processed portion of the wafer.

43. The polishing system of claim 42, further comprising a planarizing system adapted to dress the polishing pad drum, wherein the planarizing system is coupled to the controller.

44. A polishing system, comprising:

a controller;

a platen adapted to receive a wafer;

a polishing pad drum having a cylindrical shape with a length and an axis of rotation along the length, the polishing pad drum being formed by a rigid polishing pad;

a platen drive assembly coupled to the controller and adapted to linearly move the platen with respect to the polishing pad drum to move the wafer with respect to the polishing pad drum in a direction to throw debris in a direction toward a previously processed portion of the wafer; and a drum drive assembly coupled to the controller and adapted to rotate the drum and further adapted to move the polishing pad drum to provide a predetermined minimum distance with respect to the polishing pad drum when the polishing pad drum and the platen pass each other due to the linear motion.

45. The polishing system of claim 44, further comprising a planarizing system adapted to dress the polishing pad drum, wherein the planarizing system is coupled to the controller.

46. A method for planarizing a wafer, comprising:

positioning the wafer on a platen;

rotating a rigid polishing pad that forms a polishing pad drum; and creating a linear movement between the polishing pad drum and the platen to polish the wafer while moving the wafer with respect to the polishing pad drum in a direction to throw debris in a direction toward a previously processed portion of the wafer.

47. The method of claim 46, wherein the length of the polishing pad drum spans across the wafer to polish the wafer in one pass, rotating the polishing pad drum produces a tangential force between the polishing pad drum and the platen, and wherein creating a linear movement between the polishing pad drum and the platen includes creating a linear movement in the direction of the tangential force to throw debris in a direction toward a previously processed portion of the wafer to avoid interfering with polishing during the one pass.

48. The method of claim 46, wherein rotating a polishing pad drum includes controlling a rotational speed of the drum.

49. The method of claim 46, wherein rotating a polishing pad drum includes controlling a rotational direction of the drum.

50. The method of claim 46, wherein creating a linear movement between the polishing pad drum and the platen includes controlling a linear speed of the platen.

51. The method of claim 46, wherein creating a linear movement between the polishing pad drum and the platen includes controlling a linear direction of the platen.

52. The method of claim 46, wherein creating a linear movement between the polishing pad drum and the platen includes controlling a linear speed of the drum.

53. The method of claim 46, wherein creating a linear movement between the polishing pad drum and the platen includes controlling a linear direction of the drum.

54. The method of claim 46, wherein creating a linear movement between the polishing pad drum and the platen includes providing a linear movement that has a projected linear motion vector on a parallel plane that contains an axis of rotation for the polishing pad drum such that the projected linear motion vector is generally perpendicular to the axis of rotation.

55. The method of claim 46, further comprising setting a minimum distance between the platen and the polishing pad drum as the platen and the polishing pad drum pass each other.

56. A method for planarizing a wafer, comprising:

positioning the wafer on a platen;

rotating a rigid polishing pad that forms a polishing pad drum;

dressing the polishing pad drum with a planarizing system; and creating a linear movement between the polishing pad drum and the platen to polish the wafer while moving the wafer with respect to the polishing pad drum in a direction to throw debris in a direction toward a previously processed portion of the wafer.

57. The method of claim 56, wherein dressing the polishing pad drum with a planarizing system includes dressing the polishing pad drum with a finely tuned laser beam.

58. The method of claim 56, wherein the polishing pad drum has a length that spans across the wafer to polish the wafer in one pass, rotating the polishing pad drum produces a tangential force, and wherein creating a linear movement between the polishing pad drum and the platen includes creating a linear movement in the direction of the tangential force to throw debris in a direction toward a previously processed portion of the wafer to avoid interfering with polishing during the one pass.

59. The method of claim 56, wherein rotating a polishing pad drum includes controlling a rotational speed and rotational direction of the polishing pad drum.

60. The method of claim 56, wherein creating a linear movement between the polishing pad drum and the platen includes controlling a linear speed of the platen.

61. The method of claim 56, wherein creating a linear movement between the polishing pad drum and the platen includes controlling a linear direction of the platen.

62. The method of claim 56, wherein creating a linear movement between the polishing pad drum and the platen includes controlling a linear speed of the polishing pad drum.

63. The method of claim 56, wherein creating a linear movement between the polishing pad drum and the platen includes controlling a linear direction of the polishing pad drum.

64. The method of claim 56, wherein creating a linear movement between the polishing pad drum and the platen includes providing a linear movement that has a projected linear motion vector on a parallel plane that contains an axis of rotation for the polishing pad drum such that the projected linear motion vector is generally perpendicular to the axis of rotation.

65. The method of claim 56, further comprising moving the platen to set a minimum distance between the platen and the polishing pad drum as the platen and the polishing pad drum pass each other.

66. The method of claim 56, further comprising moving the polishing pad drum to set a minimum distance between the platen and the polishing pad drum as the platen and the polishing pad drum pass each other.

67. A method for planarizing a wafer, comprising:

positioning the wafer on a platen;

rotating a rigid polishing pad that forms a polishing pad drum;

dispensing a polishing slurry; and creating a linear movement between the polishing pad drum and the platen to polish the wafer using the polishing slurry while moving the wafer with respect to the polishing pad drum in a direction to throw debris in a direction toward a previously processed portion of the wafer.

68. The method of claim 67, wherein the polishing pad drum has a length that spans across the wafer to polish the wafer in one pass, rotating the polishing pad drum produces a tangential force between the polishing pad drum and the platen, and wherein creating a linear movement between the polishing pad drum and the platen includes creating a linear movement in the direction of the tangential force to throw debris in a direction toward a previously processed portion of the wafer to avoid interfering with polishing during the one pass.

69. The method of claim 67, wherein rotating a polishing pad drum includes controlling a rotational speed and rotational direction of the polishing pad drum.

70. The method of claim 67, wherein creating a linear movement between the polishing pad drum and the platen includes controlling a linear speed and a linear direction of the platen.

71. The method of claim 67, wherein creating a linear movement between the polishing pad drum and the platen includes controlling a linear speed and a linear direction of the polishing pad drum.

72. A method for planarizing a wafer, comprising:

providing a rigid polishing pad that forms a polishing pad drum with an embedded polishing abrasive;

positioning the wafer on a platen;

rotating the polishing pad drum;

creating a linear movement between the polishing pad drum and the platen to polish the wafer using the embedded polishing abrasive; and wherein the polishing pad drum has a length that spans across the wafer to polish the wafer in one pass, rotating the polishing pad drum produces a tangential force at the drum periphery between the polishing pad drum and the platen, and wherein creating a linear movement between the polishing pad drum and the platen includes creating a linear movement in the direction of the tangential force to throw debris in a direction toward a previously processed portion of the wafer to avoid interfering with polishing during the one pass.

73. The method of claim 72, wherein rotating a polishing pad drum includes controlling a rotational speed and rotational direction of the polishing pad drum.

74. The method of claim 72, wherein creating a linear movement between the polishing pad drum and the platen includes controlling a linear speed and a linear direction of the platen.

75. The method of claim 72, wherein creating a linear movement between the polishing pad drum and the platen includes controlling a linear speed and a linear direction of the polishing pad drum.

76. A process, comprising:

dressing a rigid polishing pad that forms a polishing pad drum;

positioning a wafer on a platen;

setting a predetermined distance between the polishing pad drum and the platen when they pass each other;

polishing the wafer by rotating the polishing pad drum and creating a linear movement between the polishing pad drum and the platen while moving the wafer with respect to the polishing pad drum in a direction to throw debris in a direction toward a previously processed portion of the wafer;

removing the wafer from the platen; and performing a semiconductor fabrication process on the wafer.

77. The process of claim 76, further comprising:

determining whether the wafer is to be polished again; and upon determining that the wafer is to be polished again, positioning the wafer on the platen, setting a predetermined distance minimum between the polishing pad drum and the platen when they pass each other, and polishing the wafer again by rotating the polishing pad drum and creating a linear movement between the polishing pad drum and the platen.

78. The process of claim 76, further comprising:

upon determining that the wafer is to be polished again, determining whether the polishing pad drum is to be dressed; and upon determining that the polishing pad drum is to be dressed, dressing the polishing pad drum prior to polishing the wafer again.

79. The process of claim 76, further comprising:

determining whether another semiconductor fabrication process is to be performed; and upon determining that another semiconductor fabrication process is to be performed, performing another semiconductor fabrication process, and determining whether the wafer is to be polished again.

80. The process of claim 76, wherein setting a predetermined minimum distance between the polishing pad drum and the platen when they pass each other includes moving the platen to provide the predetermined minimum distance.

81. The process of claim 76, wherein setting a predetermined minimum distance between the polishing pad drum and the platen includes moving the polishing pad drum to provide the predetermined minimum distance.

82. The process of claim 76, wherein creating a linear movement between the polishing pad drum and the platen includes linear moving the platen with respect to the polishing pad drum.

83. The process of claim 76, wherein creating a linear movement between the polishing pad drum and the platen includes linear moving the polishing pad drum with respect to the platen.

84. A process, comprising:

dressing a rigid polishing pad that forms a polishing pad drum;

setting a predetermined distance between the polishing pad drum and the platen when they pass each other;

polishing the wafer by rotating the polishing pad drum and creating a linear movement between the polishing pad drum and the platen while moving the wafer with respect to the polishing pad drum in a direction to throw debris in a direction toward a previously processed portion of the wafer;

determining whether the wafer is to be polished again;

upon determining that the wafer is to be polished again, determining whether the polishing pad is to be dressed;

upon determining that the polishing pad is to be dressed, dressing the polishing pad drum prior to polishing the wafer again; and upon determining that the polishing pad is not to be dressed, polishing the wafer again.

85. The process of claim 84, wherein determining whether the wafer is to be polished again is based on whether further polishing is required to remove a semiconductor layer.

86. The process of claim 84, wherein determining whether the polishing pad is to be dressed is based on whether the polishing pad has worn unevenly due to an uneven surface of a semiconductor layer.

* * * * *

UNITED STATES PATENT AND TRADEMARK OFFICE

CERTIFICATE OF CORRECTION

PATENT NO. : 7,121,919 B2
APPLICATION NO. : 09/944983
DATED : October 17, 2006
INVENTOR(S) : Farrar It is certified that error appears in the above-identified patent and that said Letters Patent is hereby corrected as shown below:

On the Title page, in item (73), in "Assignee", in column 1, line 1, after "ID" insert -- 83716 --.

On the Title page, in item (56), under "Other Publications", in column 2, line 2, delete "Disclusures" and insert -- Disclosures --, therefor.

On page 2, in item (56), under "U.S. Patent Documents", in column 2, line 1, after "6,419,443" delete "B1 *" and insert -- B2 * --, therefor.

On page 2, in item (56), under "Other Publications", in column 2, line 4, delete "Planerization" and insert -- Planarization --, therefor.

On Sheet 7 of 9, in FIG. 11 (Reference Numeral 1118), line 1, delete "PLANERIZING" and insert -- PLANARIZING --, therefor.

On Sheet 7 of 9, in FIG. 12 (Reference Numeral 1218), line 1, delete "PLANERIZING" and insert -- PLANARIZING --, therefor.

On Sheet 8 of 9, in FIG. 14 (Reference Numeral 1457 (Top)), delete "1457" and insert -- 1454 --, therefor.

On Sheet 8 of 9, in FIG. 14 (Reference Numeral 1457 (Bottom)), delete "1457" and insert -- 1456 --, therefor.

Column 1, line 33, delete "resistive" and insert -- reactive --, therefor.

Column 1, line 34, delete "blanked" and insert -- blanket --, therefor.

Column 1, line 43, delete "buffering" and insert -- buffing --, therefor.

Column 9, line 20, delete "blank" and insert -- blanket --, therefor.

Column 18, line 38, in Claim 84, after "and" delete "the" and insert -- a front surface of a --, therefor.

Column 18, line 38, in Claim 84, after "platen" insert -- disposed to hold a wafer --.

UNITED STATES PATENT AND TRADEMARK OFFICE

CERTIFICATE OF CORRECTION

PATENT NO. : 7,121,919 B2
APPLICATION NO. : 09/944983
DATED : October 17, 2006
INVENTOR(S) : Farrar It is certified that error appears in the above-identified patent and that said Letters Patent is hereby corrected as shown below:

Column 18, line 42, in Claim 84, after "platen" insert -- holding the wafer --.

Signed and Sealed this

Twenty-second Day of May, 2007

JON W. DUDAS
*Director of the United States Patent and Trademark Office*